US007614740B2

(12) United States Patent
Asanuma

(10) Patent No.: US 7,614,740 B2
(45) Date of Patent: Nov. 10, 2009

(54) IMAGE FORMING APPARATUS HAVING A RECESSED PART IN OUTER COVERING

(75) Inventor: Shoji Asanuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 326 days.

(21) Appl. No.: 11/360,088

(22) Filed: Feb. 22, 2006

(65) Prior Publication Data

US 2006/0187258 A1 Aug. 24, 2006

(30) Foreign Application Priority Data

Feb. 24, 2005 (JP) ..... 2005-048489

(51) Int. Cl.
*B41J 2/01* (2006.01)

(52) U.S. Cl. ..... 347/108; 399/107; 399/381; 399/393

(58) Field of Classification Search ..... 347/108; 399/107, 381, 393
See application file for complete search history.

(56) References Cited

U.S. PATENT DOCUMENTS

| | | | | |
|---|---|---|---|---|
| 5,943,081 | A * | 8/1999 | Uchida et al. | 347/104 |
| 6,132,026 | A * | 10/2000 | Taylor et al. | 347/32 |
| 6,507,720 | B2 * | 1/2003 | Kabumoto et al. | 399/258 |
| 6,633,733 | B2 * | 10/2003 | Mochimaru et al. | 399/45 |
| 2002/0003554 | A1 * | 1/2002 | Hayakawa et al. | 347/31 |
| 2004/0131384 | A1 * | 7/2004 | Miyaji et al. | 399/124 |
| 2004/0169694 | A1 * | 9/2004 | Yamada | 347/19 |

FOREIGN PATENT DOCUMENTS

| | | |
|---|---|---|
| JP | 11-240224 | 9/1999 |
| JP | 2002-11874 | 1/2002 |
| JP | 2003-285498 | 10/2003 |
| JP | 2004-82478 | 3/2004 |
| JP | 2004-179741 | 6/2004 |
| JP | 2004191826 | 7/2004 |
| JP | 2004-284084 | 10/2004 |
| JP | 2005-17690 | 1/2005 |
| JP | 2005-199688 | 7/2005 |

OTHER PUBLICATIONS

Jul. 14, 2009 Japanese office action in connection with a counterpart Japanese patent application No. 2005-048489.

* cited by examiner

*Primary Examiner*—Manish S Shah
*Assistant Examiner*—Laura E Martin
(74) *Attorney, Agent, or Firm*—Cooper & Dunham, LLP

(57) ABSTRACT

An image forming apparatus includes an apparatus body having an image forming part that forms an image by scanning a recording head discharging droplets of a recording liquid. A paper eject part is located in an upper portion of the apparatus body for stacking recording papers having the image formed thereon by the image forming part. An image reading part is located above the paper eject part. The apparatus body accommodates a maintenance and recovery mechanism and a waste discharge receiving part therein on both ends of a scanning range of the recording head. An outer covering of the apparatus body has a shape in which a portion corresponding to at least one of the maintenance and recovery mechanism and the waste discharge receiving part is recessed relative to other portions of the outer covering.

9 Claims, 10 Drawing Sheets

IMAGE FORMING APPARATUS HAVING A RECESSED PART IN OUTER COVERING

BACKGROUND

1. Technical Field

This disclosure generally relates to image forming apparatuses and, more particularly, to an image forming apparatus having an image forming part for forming an image by scanning a recording head that discharges droplets of a recording liquid.

2. Description of the Related Art

Generally, there is known an image forming apparatus, such as a printer, a facsimile machine, a copier or a combination machine having the functions of those, having an image forming part using electrophotography. There also is an image forming apparatus having an image forming part using an inkjet recording method. According to the inkjet recording method, a recording head is constituted by a liquid discharge head that discharges droplets of a recording liquid so as to form an image on a recording medium by adhering the droplets of the recording liquid on the recording medium while conveying the recording medium. Hereinafter, the recording medium may be referred to as a recording paper, which does not limit a material of the recording medium and is used in the same meaning as a recording medium or a transfer material. Additionally, the droplets of the recording liquid may be referred to as ink droplets. Further, the image formation may be used in the same meaning as recording, printing, image printing or character printing.

In the meantime, an image forming part using the inkjet recording method must have a mechanism to maintain and recover a performance of the recording head that discharges the ink droplets. Such a maintenance and recovery mechanism generally comprises a moisture retention cap, a suction cap, a wiper blade and a waste discharge receiver. The moisture retention cap covers a nozzle surface with a high sealing effect so as to prevent the recording liquid from increasing in viscosity or adhering to the nozzle surface due to natural evaporation of the recording liquid such as ink. The suction cap is for suctioning and discharging the recording liquid, of which viscosity has been increased, from the nozzle. The suction cap may also serve as the moisture retention cap. The wiper blade wipes and removes the recording liquid adhering on the nozzle surface. The wiper blade may be referred to as a cleaning blade, a wiper, a blade member or a blade. The waste discharge receiver receives the droplets of recording liquid which do not contribute the actual image formation.

When using a serial scan method which forms an image on a recording paper while scanning a recording head mounted on a carriage in a main scanning direction, the maintenance and recovery mechanism is located at an end part in the main scanning direction, and the waste discharge receiver is also located at the end part in the main scanning direction. Alternatively, the maintenance and recovery mechanism may be located each of opposite ends in the main scanning direction as disclosed in Japanese Laid-Open Patent Application 2004-284084.

It should be noted that Japanese Laid-Open Patent Applications No. 2003-285498, No. 11-240224 and No. 2002-11874 disclose examples of a conventional image forming apparatus including a conventional inkjet recording apparatus.

As mentioned above, if the image forming part for forming an image according to the serial scan method using a recording head constituted as a liquid discharge head as mentioned above, a maintenance and recovery mechanism and the waste discharge receiving part are located on one or both ends in the main scanning direction of a carriage, there is a problem in that the size of the apparatus body is increased, which increases a space occupied by the apparatus.

Additionally, in the image forming part having such an image forming part, if an inner body paper eject structure (a paper eject part is provided in a space between the apparatus body and the original reading apparatus), which is used as a structure of a general image forming apparatus, is used, there is a problem in that it is difficult to see recording papers stacked on a paper eject part since an operation part for operating the apparatus may be an obstacle.

Further, in a general image forming apparatus, it is very difficult to operate an operation part, which is operated by an operator, while the operator is sitting, for example, on a wheel chair since the operation part is configured and arranged to operate from above. Thus, the operation part may use a tilt system, but, in such a case, there also is a problem in that it is difficult to see recording papers ejected on the inner body paper eject part.

SUMMARY

In an aspect of this disclosure, there is provided an image forming apparatus that requires a small space to be occupied by the apparatus and improves convenience of use for a user.

In another aspects of this disclosure, there is provided an image forming apparatus comprising: an apparatus body having an image forming part that forms an image by scanning a recording head discharging droplets of a recording liquid; a paper eject part located in an upper portion of the apparatus body for stacking recording papers having the image formed thereon by the image forming part; and an image reading part located above the paper eject part, wherein the apparatus body accommodates a maintenance and recovery mechanism and a waste discharge receiving part therein on both ends of a scanning range of the recording head, the maintenance and recovery mechanism for maintaining and recovering a performance of the recording head, the waste discharge receiving part for receiving the droplets that do not contribute formation of the image; and an outer covering of the apparatus body has a shape in which a portion corresponding to at least one of the maintenance and recovery mechanism and the waste discharge receiving part is recessed relative to other portions of the outer covering.

In the above-mentioned image forming apparatus, the maintenance and recovery mechanism and the waste discharge receiving part may be located on opposite end sides of the apparatus body in a front-to-rear direction thereof. Additionally, a paper supply cassette for accommodating the recording papers therein may be detachably attached under the image forming part in the apparatus body, and an outer configuration of the paper supply cassette has a slanting part when viewed from a side, the slanting part slanting rearward from a relatively protruded part of a front face of the paper supply cassette, the relatively protruded part corresponding to at least one of the maintenance and recovery mechanism and the waste discharge receiving part. A backside of the apparatus body may be formed in a curved shape.

The above-mentioned image forming apparatus may further comprise an operation part located above the paper eject part and on a front side of the apparatus body, wherein the operation part has a substantially flat shape in which a part of a front edge thereof is recessed rearward. The operation part may be configured and arranged to be tilted to face forward, and the paper eject part has a shape lowered toward a paper eject opening from which the recording papers are ejected.

In the above-mentioned apparatus, portions of the outer covering of the apparatus body, which portions does not correspond to the maintenance and recovery apparatus or the waste discharge receiving part is recessed relatively, and, thus, a space occupied by the image forming apparatus is reduced and the visual size of the image forming apparatus also reduced.

Additionally, there is provided according to another aspect of this disclosure an image forming apparatus comprising: an apparatus body having an image forming part that forms an image by scanning a recording head discharging droplets of a recording liquid in front-to-rear and rear-to-front directions; a paper eject part located in an upper portion of the apparatus body for stacking recording papers having the image formed thereon by the image forming part; an image reading part located above the paper eject part; and an operation part located above the paper eject part and on a front side of the apparatus body, wherein the operation part has a substantially flat shape in which a part of a front edge thereof is recessed rearward.

In the above-mentioned apparatus, since the front edge of the operation part is partially recessed rearward, the recording papers ejected in the apparatus body are seen easily without no obstacle, which improves convenience of use of the image forming apparatus.

In the above-mentioned image forming apparatus, the operation part may be configured and arranged to be tilted to face forward, and the paper eject part has a shape lowered toward a paper eject opening from which the recording papers are ejected.

Further there is provided according to another aspect of this disclosure an image forming apparatus comprising: an apparatus body having an image forming part that forms an image by scanning a recording head discharging droplets of a recording liquid in front-to-rear and rear-to-front directions; a paper eject part located in an upper portion of the apparatus body for stacking recording papers having the image formed thereon by the image forming part; an image reading part located above the paper eject part; and an operation part located above the paper eject part and on a front side of the apparatus body, wherein the operation part is configured and arranged to be tilted to face forward, and the paper eject part has a shape lowered toward a paper eject opening from which the recording papers are ejected.

In the above-mentioned apparatus, since the operation part can be tilted, the operation panel can be operated at a lower position. Additionally, since a portion of the paper eject part near the paper eject opening is lowered, the recording papers ejected in the apparatus body can be seen easily even if the operation part is at the tilted position.

The above-mentioned and others aspects, features and advantages will become more apparent from the following detailed description when read in conjunction with the accompanying drawings.

DETAILED DESCRIPTION OF THE PREFERRED EMBODIMENTS

Figure 1:
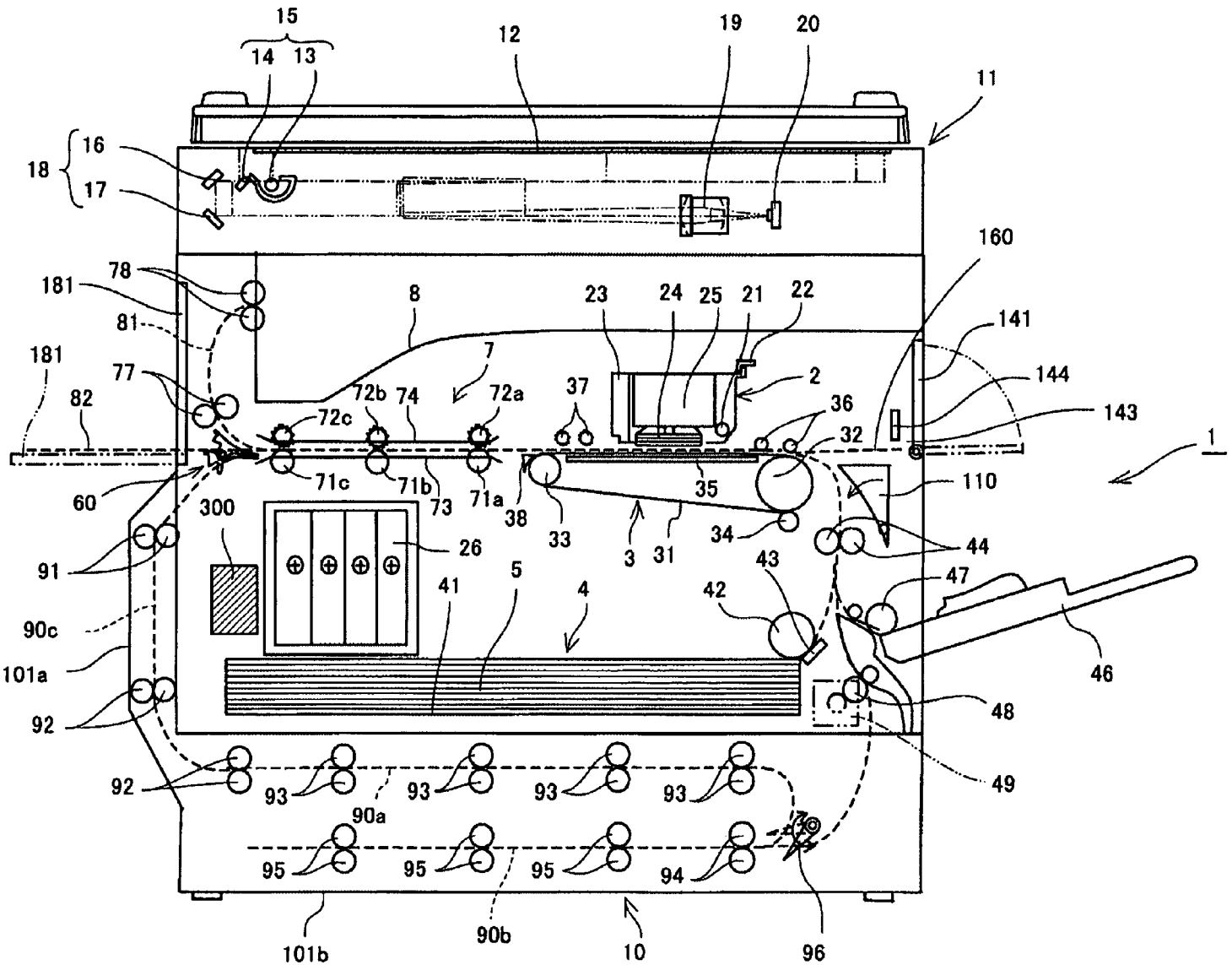
FIG. 1 is a structure diagram of an outline of an apparatus body and a mechanical part of an image reading part provided in an image forming apparatus to which the present invention is applied.
Figure 2:
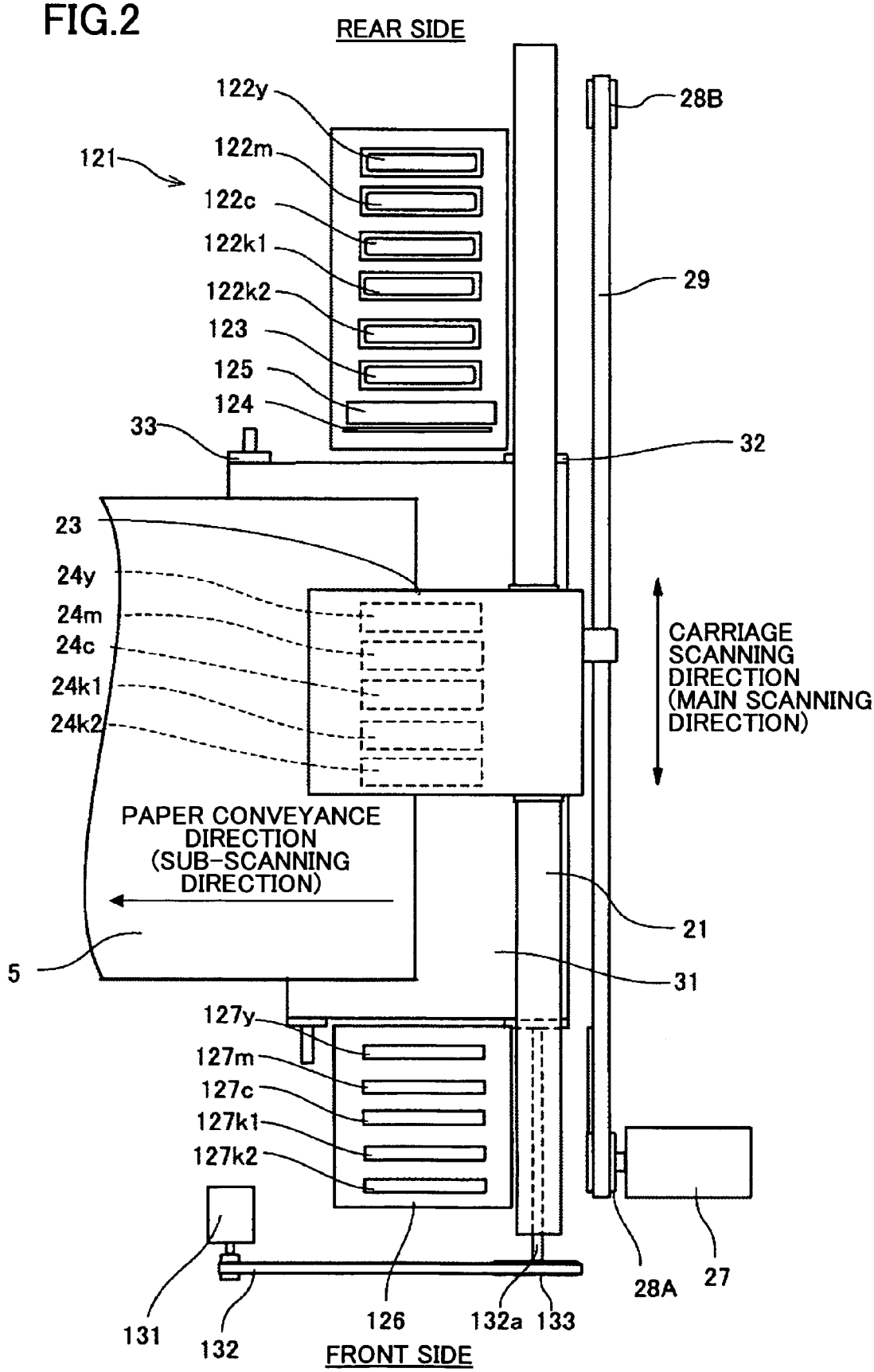
FIG. 2 is a plan view of an image forming part and a sub-scanning conveyance part provided in the apparatus body shown in FIG. 1.

A description will now be given, with reference to the drawings, of an image forming apparatus according to an embodiment of the present invention. First, an apparatus body and an image reading part of the image forming apparatus according to the embodiment of the present invention will be described with reference to FIG. 1 and FIG. 2. FIG. 1 is a structure diagram of an outline of the apparatus body and the mechanical part of the image reading part. FIG. 2 is a plan view of an image forming part and a sub-scanning conveyance part provided in the apparatus body.

The apparatus body 1 of the image forming apparatus shown in FIG. 1 comprises the image forming part (means) 2 for forming an image while conveying a recording paper and the sub-scanning conveyance part 3 for conveying the recording paper. The recording paper 5 is fed from a paper supply part (means) 4 including a paper supply cassette provided on a bottom of the apparatus body 1 one sheet by one sheet. A desired image is formed (recorded) by discharging liquid droplets to the recording paper 5 by the image forming part while conveying the recording paper 5 in a position facing the image forming part 2 by the sub-scanning conveyance part 3. Then, in a case of one-side printing, the recording paper 5 is ejected onto a paper eject tray 8, which is a paper eject part formed on an upper surface of the apparatus body 1, through a paper eject conveyance part (means) 8. In a case of both-side printing, the recording paper 5 is fed to a both-side unit 10 in the middle of the paper eject conveyance part 7 and a switch back conveyance is performed to feed the recording paper 5 to the sub-scanning conveyance part 3 again. Then, an image is formed on a backside of the recording paper 5, and the recording paper 5 having images formed on both sides thereof is ejected onto the paper eject tray 8.

Moreover, the image reading part (scanner part) 11 for reading an image is provided in an upper portion of the apparatus body above the paper eject tray 8, the image reading part serving as an input system of image data (print data) used by the image forming part to form an image. The image reading part 11 reads an image of an original placed on a contact glass 12 by moving a scan optical system 15 including an illumination light source 13 and a mirror 14 and a scan optical system 18 including mirrors 16 and 17. The original image scanned by the scan optical systems 15 and 18 is read as an image signal by an image reading element 20 located behind a lens 19. The thus-generated image signal is changed into digital data and is subjected to image processing so that printing is performed using the image-processed print data.

Furthermore, the image forming apparatus is capable of receiving print data including image data from external sources through an input system of image data (print data) to be used by the image forming part 2 to perform printing after processing the image data. The external sources include an image processing apparatus such as an external personal computer or the like, a picture taking apparatus such as a digital camera, etc, and are connected to the image forming apparatus via a cable line or a network.

Here, in the image forming part 2, a carriage 23 is supported by a guide rod 21 and a guide rail 22 as also shown in FIG. 2 according to a cantilever support and movable in the main scanning direction. The carriage 23 is moved in the main scanning direction by a timing belt 29 bridged between a drive pulley 28A driven by a main scanning motor 27 and an idle pulley 28B.

A recording head 24, which is constituted by a liquid droplet discharge head discharging liquid droplets of each color, is mounted on the carriage 23. The image forming part is a shuttle type which forms an image on the recording paper 5 by discharging the liquid droplets while moving the carriage 23 in the main scanning direction and feeding the recording paper 5 by the sub-scanning conveyance part 3 in a paper conveyance direction (sub-scanning direction).

The recording head 24 comprises five pieces of liquid droplet discharge heads including two liquid droplet discharge heads 24*k*1 and 24*k*2 discharging black (Bk) ink and three liquid droplet discharge heads 24*c*, 24*m* and 24*y* discharging cyan (C) ink, magenta (M) ink and yellow (Y) ink, respectively. Hereinafter, the heads are referred to as the recording head 24 when there is no need to distinguish each color. Each color ink is supplied to the recording head 24 from a sub-tank 25 mounted on the carriage 23.

On the other hand, as shown in FIG. 1, an ink cartridge serving as a recording liquid cartridge can be detachably attached to a cartridge attaching part of the carriage through a front face of the apparatus body 1. The ink cartridge stores black (Bk) ink, cyan (C) ink, magenta (M) ink and yellow (Y) ink. Ink of each color is supplied from the ink cartridge to the sub-tank 25. It should be noted that the black ink is supplied to the two sub-tanks 25 from one ink cartridge.

It should be noted that a piezo-type head, a thermal-type head, an electrostatic-type head, etc., may be used as the recording head. The piezo-type head discharges ink droplets by using a piezoelectric element a pressure generating means (actuating means) for pressurizing ink in an ink passage (pressure-generating chamber) so as to deform a diaphragm forming a wall of the ink passage to change a volume of the ink passage. The thermal type head discharges ink droplets by a pressure generated by forming vapor of ink by heating the ink in an ink passage using a resistance heating element. The electrostatic-type had discharges ink droplets by changing a volume of an ink passage by arranging a diaphragm forming a wall of the ink passage and an electrode facing each other and generating an electrostatic force between the diaphragm and the electrode.

Additionally, a maintenance and recovery mechanism 121 is located in a non-printing area on an end in the scanning direction of the carriage 23 (rear side of the apparatus body) as shown in FIG. 2. The maintenance and recovery mechanism 121 maintains and recovers a good state of the nozzles of the recording head 24. The maintenance and recovery mechanism 121 comprises five pieces moisture retention caps 122*k*2, 122*k*1, 122*c*, 122*m* and 122*y*, a suction cap 123, a wiper blade 124 and a waste discharge receiving member 125.

The moisture retention caps 122*k*2, 122*k*1, 122*c*, 122*m* and 122*y* cover nozzle surfaces of the recording head 24, respectively, with a high sealing effect. The moisture retention caps 122*k*2, 122*k*1, 122*c*, 122*m* and 122*y* may be referred to as a moisture retention cap 122 when there is no need to distinguish each color. The wiper blade 124 wipes the nozzle surface o the recording head 24. The waste discharge receiver 125 receives the droplets of recording liquid which do not contribute to the actual recording (image formation).

Furthermore, a waste discharge receiving member 126 is provided in a non-printing area on an opposite side in the scanning direction of the carriage 23 as shown in FIG. 2. The waste discharge receiving member 126 is provided for performing discharge of liquid droplets from five recording heads 24 that do not contribute to actual recording (image formation). Five openings 127*k*2, 127*k*1, 127*c*, 127*m* and 127*y* are formed in the waste discharge receiving member 126 in correspondence to the recording heads 24. The opening may be referred to as an opening 127 when there is no need to distinguish each color.

Figure 3:
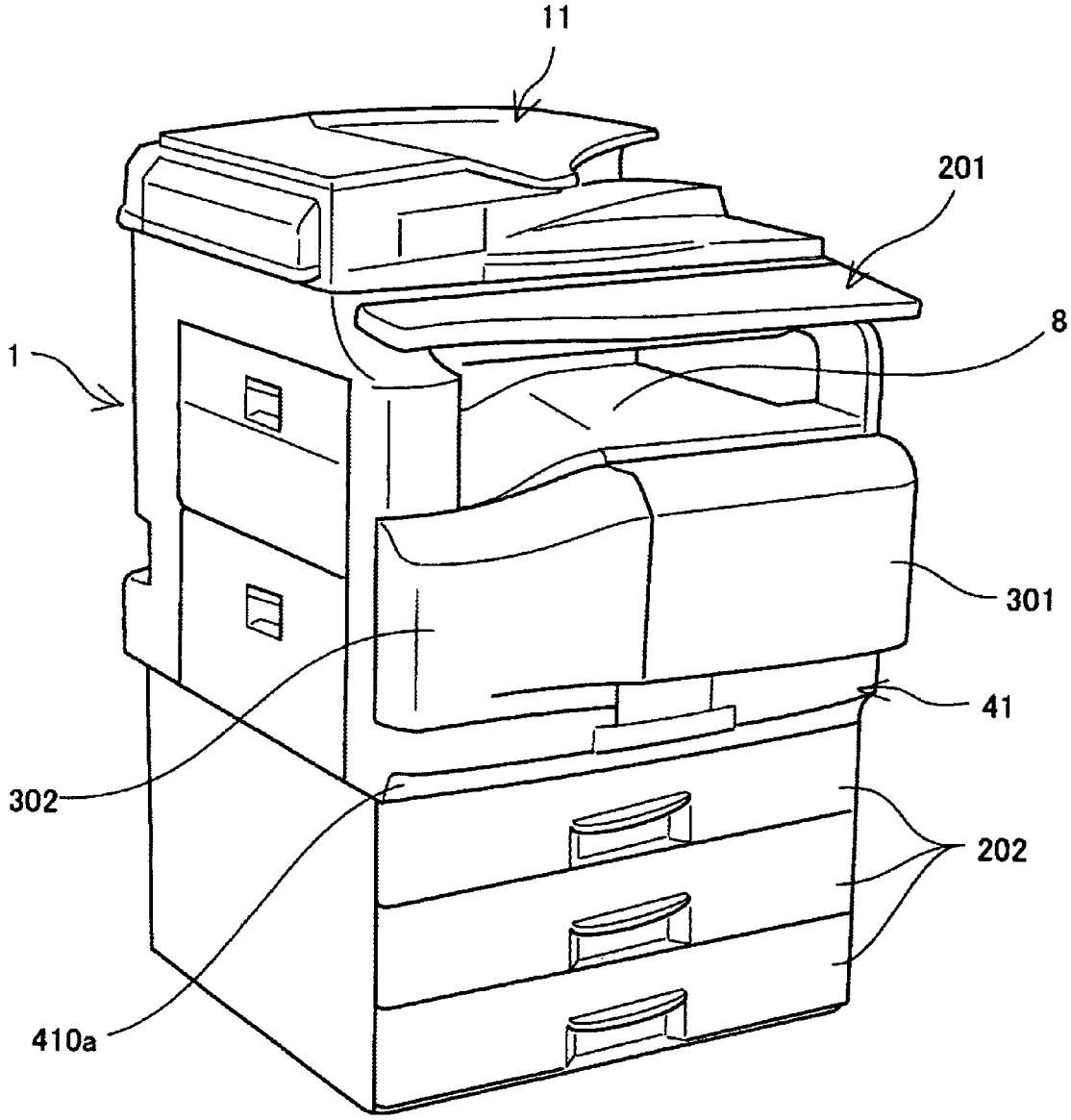
FIG. 3 is a perspective view of an image forming apparatus according to an embodiment of the present invention.

As shown also in FIG. 3, the sub-scanning conveyance part 3 comprises an endless conveyance belt 31, a charge roller 34, a guide member 35, a pair of press rollers (pressure rollers) 36, a pair of spur rollers 37 and a separation claw 38. The conveyance belt 31 is bridged between a conveyance roller 32, which is a drive roller, and an idle roller 33, which is a tension roller so as to convey the recording paper 5 while facing the recording paper 5 to the image forming part after changing the direction of the recording paper 5 feed from a lower portion by 90 degrees. The charge roller 34 serves as charging means for charging the surface of the conveyance belt 31 by being applied with a high-voltage, which is an alternating voltage from a high-voltage power supply. The guide member 35 guides the conveyance belt 31 in an area in which the conveyance belt 31 faces the image forming part 2. The press rollers 36 press the recording paper 5 against the conveyance belt 31 at positions where the press rollers 36 face the conveyance roller 32. The spur rollers 37 press the upper side of the recording paper on which an image has been formed by the image forming part 2. The separation claw 38 separates the recording paper 5 from the conveyance belt 31 on which the image has been formed.

The conveyance belt 31 of the sub-scanning conveyance part 3 is configured and arranged to rotate in the paper conveyance direction (sub-scanning direction) by the conveyance roller being rotated by a sub-scanning motor 131 via a timing belt and a timing roller 133. It should be noted that the conveyance belt 31 has a dual layer structure comprising a front layer and a back layer. The front layer, which serves as a paper attracting surface, is formed of a pure resin material that is not subjected to a resistance adjustment such as an ETFE pure material. The back layer (a medium resistance layer or a grounding layer) is formed of the same material as the front layer but is not subjected to the resistance adjustment. The structure of the conveyance belt 31 is not limited to the dual layer structure, and a single layer structure or a three-layer structure may be used.

The paper supply part 4 comprises a paper supply cassette 41, a paper supply roller 42, a friction pad 43, and a registration roller 44. The paper supply cassette 41 accommodates a number of the recording papers 5 in a stacked state and is removably insertable from the front face side of the apparatus body 1. The paper supply roller 42 and the friction pad 43 together feed the recording papers 5 one by one. The registration roller 44 registers the recording papers 5 that have been fed from the paper supply cassette 41. The paper supply part 4 also comprises a manual feed tray 46, a manual feed roller 47 and a conveyance roller 48. The manual feed tray accommodates a number of recording papers 5 in a stacked stated. The manual feed roller 47 feeds the recording papers from the manual feed tray 46 one by one. The conveyance roller 48 is for conveying the recording papers 5 fed from a paper feed cassette attached as an option to a lower portion the apparatus body 1 and a both-side unit 10 mentioned later. The paper feed roller 42, the registration roller 44, the manual feed roller 47 and the manual feed roller 48 are driven by a paper feed motor (drive means) 49, which is an HB-type stepping motor, through an electromagnetic clutch (not shown in the figure).

The paper eject conveyance part 7 comprises three conveyance rollers 71*a*, 71*b* and 71*c* (may be referred to as a conveyance roller 71 when there is no need distinguish from each other), spurs 72*a*, 72*b* and 72*c* (may be referred to as a spur 72 when there is no need to distinguish from each other) facing the conveyance rollers 71*a*, 71*b* and 71*c*, respectively, a lower guide part 73 and an upper guide part 74, a pair of reverse rollers 77, a pair of reverse paper eject rollers 78. The conveyance rollers 71*a*, 71*b* and 71*c* and the spurs 72*a*, 72*b* and 72 together convey the recording papers 5 separated by the separation claw 38 of the sub-scanning conveyance part 3. The lower guide part 73 and the upper guide part 74 guide the recording papers 5 being conveyed between the conveyance roller 71 and the spur 72. The reverse rollers 77 and the reverse paper eject rollers 78 feed the recording papers 5 fed out of the lower guide part 73 and the upper guide part 74 to the eject tray 8 in a face down state through a reverse paper eject path 81, which is a first conveyance path. It should be noted that a conveyance path 70 for conveying the recording papers 5 is formed between the lower guide part 73 and the upper guide part 74.

It should be noted that there are provided on the exit side of the conveyance path 70 a first paper eject path 81, a second paper eject path 72 and a branch mechanism 60. The first paper eject path 81 is for reversing and ejecting the recording papers 5 onto the paper eject tray 8. The second paper eject path 82 is for ejecting the recording papers 5 onto the straight paper eject tray 181 mentioned later. The branch mechanism 60 is for switching the conveyance path between the second paper eject path 82 and the path of the both-side unit 10.

The both-side unit 10 comprises a vertical conveyance part 101*a* and a horizontal conveyance part 101*b* that are integrated with each other. The vertical conveyance par 101*a* constitutes a vertical both-side conveyance path 90*c* receiving the recording papers 5 fed thereto from the apparatus body 1 and conveys the recording papers 5 therethrough. The horizontal conveyance part 101*b* constitutes a horizontal taking conveyance path 90*a*, which continues from the vertical both-side conveyance path 90*c* and conveys the recording papers 5 in a horizontal direction, and a switch-back conveyance path 90*b*.

A pair of conveyance rollers 91 are provided to the vertical both-side conveyance path 90*c* so as to feed the recording papers 5 downward. A pair of conveyance rollers 92 are provided to the vertical both-side conveyance path 90*c* so as to feed the recording papers 5 to the horizontal taking conveyance path 90*a*. Five pairs of conveyance rollers 93 are provided to the horizontal taking conveyance path 90*a*. A both-side exit roller 94 and three pairs of both-side conveyance rollers 95 are provided to the switch back conveyance path 90*b* so as to reverse and resupply the recording papers 5 fed from the horizontal taking conveyance path 90*a*.

Additionally, a swingable branch plate 96 is provided so as to switch between a conveyance path from the horizontal conveyance path 90*a* to the switch back conveyance path 90*b* and a conveyance path for resupply from the switch back conveyance path 90*b* to the pair of conveyance rollers 48. The branch plate 96 is swingable between the switch back side position indicated by solid lines and resupply side position indicated by dashed lines.

The recording papers 5 fed out of the both-side unit 10 are fed to the above-mentioned conveyance rollers and then to the registration roller 44.

Additionally, an open and close guide plate 110 is swingably provided as shown in FIG. 1 so as to prevent generation of a back tension to the recording papers 5 by forming a loop (slack) in the recording papers 5 between the conveyance roller 32 and the press rollers 36 of the sub-scanning conveyance part 3 and the registration rollers 44 when the recording papers 5, which are fed from the above-mentioned paper supply cassette 41, the manual paper feed tray, and the both-side unit 10, by the registration rollers 44.

The open and close guide plate 110 guides the recording papers 5 by swinging in a direction indicated by an arrow from a state indicated in the figure when feeding the recording paper 5 from the registration rollers 44 to the sub-scanning conveyance part 3, and set a state where a loop can be formed at a timing when the recording paper 5 reaches the sub-scanning conveyance part 3.

Furthermore, in the image forming apparatus, a single sheet manual feed tray 141 is provided to the apparatus body 1 so as to be opened and closed on a side portion of the apparatus body 1 as shown also in FIG. 1 so as to permit manual feed of a single sheet. The single sheet manual feed tray 141 is opened at a position indicated by a double dashed chain lined. The recording paper 5 manually fed from the single sheet paper supply tray 141 is guided by the upper surface of the open and close guide plate 110 and can be inserted into between conveyance roller 32 and the pressure rollers 36 along a straight line.

On the other hand, in order to eject the recording papers on which the image formation has been performed along a straight line, a straight paper eject tray 181 is provided on the other side of the apparatus body 1 so as to be open and closed. By opening the straight paper eject tray 181, a straight paper eject path 82 as a second paper eject path is formed to eject the recording papers 5, which is fed from the lower guide part 73 and the upper guide part 74 to the paper eject conveyance part 7.

Thereby, if a recording paper such as a thick paper which is difficult to convey along a curved path, the recording paper can be conveyed along a straight line from the single sheet manual paper supply tray 141 to the straight paper eject tray 181. Of course, a recording paper such as a regular paper can also be supplied from the single sheet manual paper feed tray 141 and ejected to the straight paper eject tray 181 along a straight line.

A brief description will be given of an image forming operation by the image forming apparatus. The charge roller 34 is applied with an alternating high-voltage of a square wave having positive and negative poles, and the charge roller 34 is in contact with an insulation layer (front layer) of the conveyance belt 31. Thus, positive and negative charges are applied alternately onto the front layer of the conveyance belt 31 in a belt-like pattern. Thus, charges having a predetermined charge width are performed, thereby generating uneven electric field on the conveyance belt 31.

Thus, when the recording paper 5 is fed to the conveyance belt 31 on which the uneven electric field is generated by formation of electric charges of positive and negative poles from the paper supply part 4, the manual paper feed part 46, the both-side unit 10 or the single sheet manual paper feed tray 141, the recording paper 5 is polarized instantaneously in accordance with directions of the electric fields, and, thereby, the recording paper 5 is attracted onto the conveyance belt 31 and is conveyed by the conveyance belt 131.

Then, an image is formed on the recording paper by discharging liquid droplets of the recording liquid in accordance with print data while intermittently conveying the recording paper 5 by the conveyance belt 31. A leading end side of the recording paper 5 on which the image has been formed is separated from the conveyance belt 31 by the separation claw 38, and the recording paper 5 is ejected on to the paper eject tray 8 or the straight paper eject tray 181. Alternatively, the recording paper 5 is fed to the both-side unit 10 to form an image on the other side, and, thereafter, the recording paper 5 is ejected.

Figure 4:
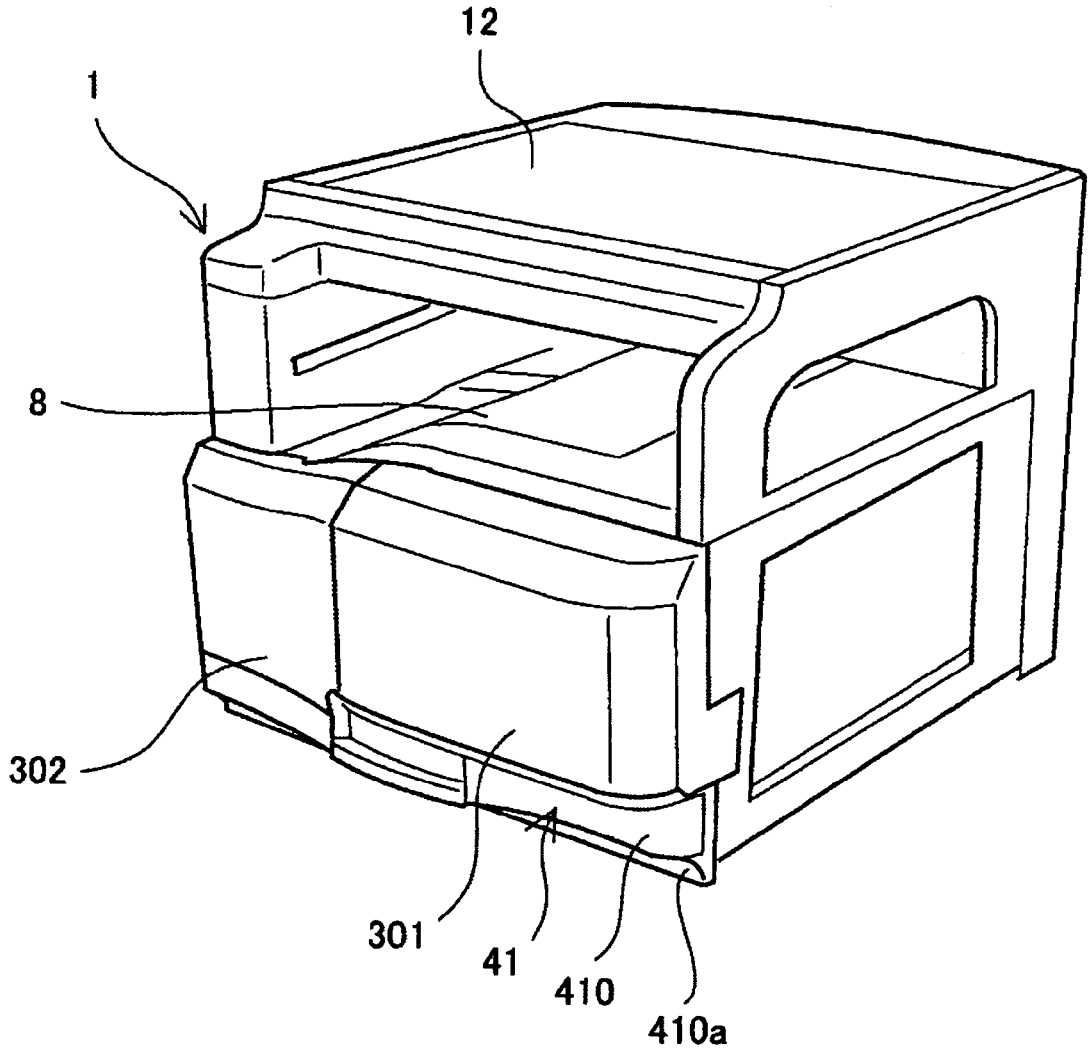
FIG. 4 is a perspective view of an apparatus body of the image forming apparatus according to the embodiment of the present invention.
Figure 5:
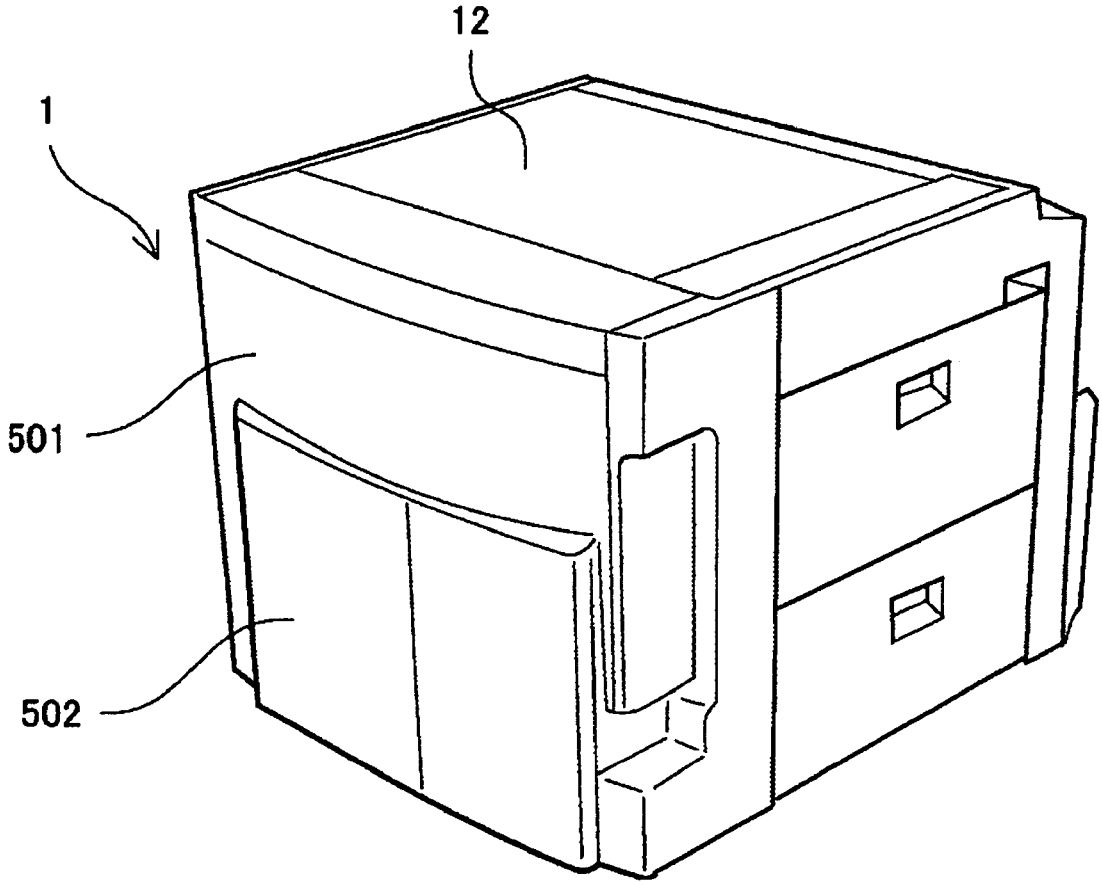
FIG. 5 is a perspective view of the apparatus body shown in FIG. 4 viewed from a rear side.
Figure 6:
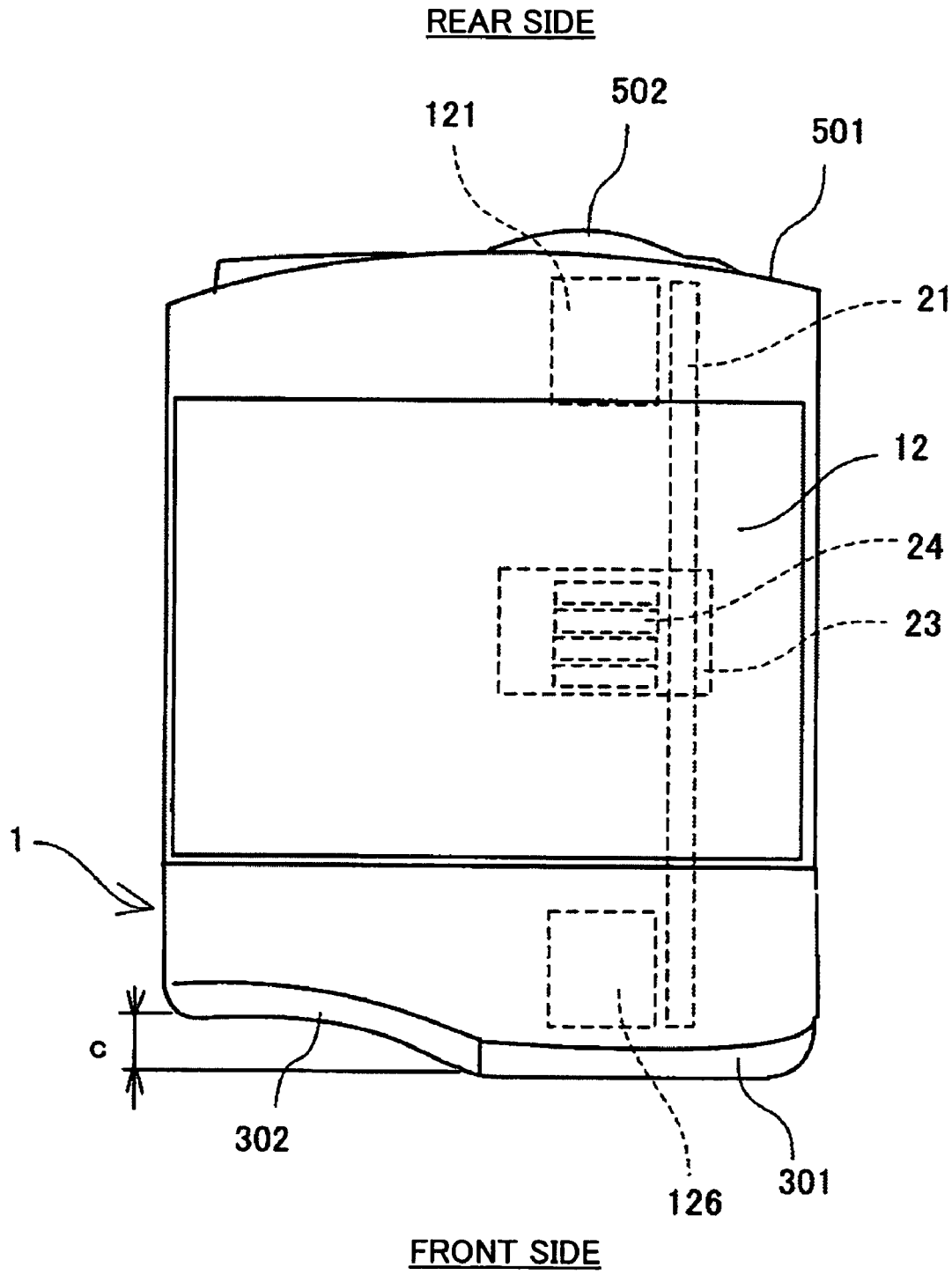
FIG. 6 is a plan view of the apparatus body shown in FIG. 4.

A description will now be given, with reference to FIG. 4 through FIG. 6, of the image forming apparatus to which the present invention is applied. FIG. 4 is a perspective view of an apparatus body of the image forming apparatus according to the embodiment of the present invention. FIG. 5 is a perspective view of the apparatus body viewed from a rear side in FIG. 4. FIG. 6 is plan view of the apparatus body.

The image forming apparatus comprises, as mentioned above: the apparatus body 1 having the image forming part 2, etc.; the image reading part 11 provided on the apparatus body 11; the paper eject part 8 that ejects recording papers on the upper portion of the apparatus body 1; and the tilt-type operation part (operation panel) 201 swingably provided on the front side of the apparatus body 1 and above the paper eject part 8 to give predetermined instructions to the image reading part 11, etc., and display desired information thereon.

It should be noted that the image forming apparatus is provided with a plurality of additional paper supply trays 202 stacked on one on another in multiple stages in the lower portion of the apparatus body 1 instead of the above-mentioned both-side unit 10.

A description will be given, also with reference to FIG. 6 and FIG. 7, of the configuration of the outer covering of the apparatus body 1 of the image forming apparatus.

On the front side of the apparatus body 1, there are provided a right front cover 301 and a left front cover 302. The right front cover 301 can be opened and closed so that an engine unit, which incorporates the image forming part 2 and the sub-scanning conveyance part 3 into a single unit, can be assembled to the apparatus body 1. The left front cover 302 can be opened and closed so that the ink cartridges 26 can be replaced by opening the left front cover 302. When viewed from above, as shown in FIG. 6 and also FIG. 7, the left front cover 302, which corresponds to the waste discharge receiving part 126 of the engine unit, projects relative to the right front cover 301, and, therefore, the right front cover 301, which corresponds to the attaching part of the ink cartridges 26, is retracted relatively. That is, the front surface of the left front cover 302 is curved and recessed or retracted from the front surface of the right front cover 301 by a distance c as indicated in FIG. 6.

That is, in the serial scan type image forming part, since the maintenance and recovery mechanism 121 and the waste discharge receiving part 126 are needed to maintain and recover the performance of the recording head 24 as mentioned above, the scanning area of the carriage 23 must be wider than a width of the recording paper to be passed through. Thus, in the structure in which the carriage 23 is scanned in a front-to-rear direction of the apparatus body 1, the waste discharge receiving part 126, for example, is located on the front side.

In this case, if the configuration of the front side is set in accordance with an outer configuration of the waste discharge receiving part 126, a waste space may be formed in a part where the ink cartridges 26 are attached. Thus, the apparatus body 1 is increased in its size, which increases a space occupied by the apparatus body, and the apparatus becomes large in its appearance.

Then, as shown in FIG. 6, by making a configuration in which the portion (the portion corresponding to the left front cover 302) that does not correspond to the waste discharge receiving part 126 (or the maintenance and recovery mechanism) in a plan view is recessed or retracted relatively, the space occupied by the entire apparatus is reduced and miniaturization can be attempted, and the depth of the entire apparatus becomes smaller visually. A further visual miniaturization can be attempted by forming the outer configuration of the right front cover 301 and the left front cover 302 in a gently curved shape as shown in the figures.

It should be noted that although the maintenance and recovery mechanism and the waste discharge receiving part of the image forming part are located on one end in the front-to-rear direction, if the maintenance and recovery mechanism are located on an end in the side-to-side direction of the apparatus body, the right side or the left side of the apparatus body may be configured to be retracted or recessed.

Additionally, as mentioned above, in a plan view, if the right front cover 301, which corresponds to the waste discharge receiving part 126 of the engine unit, protrudes relatively, and the left front cover 302, which corresponds to the ink cartridges 26, is recessed or retracted relatively, and if the paper supply cassette 41 is detachable attached to the lower portion of the apparatus body 1, and if the outside configuration of the paper supply cassette 41 is made similar to the configuration of the right front cover 301 and the left front cover 302, the installation surface of the apparatus body 1 corresponds to the protruding right front cover 301, and, thus, a sufficient space saving cannot be attempted. Additionally, if the additional paper supply cassette 202 is attached, a travel distance of the cassette is increased when drawing the cassette and setting recording papers in the additional paper supply cassette 202.

Figure 8:
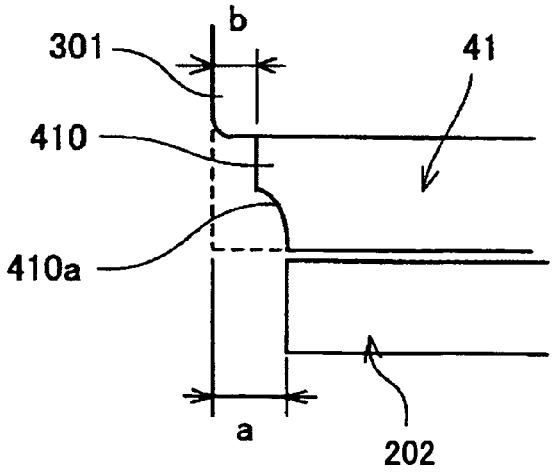
FIG. 8 is an enlarged view of a part of the apparatus body shown in FIG. 7.

That is, if the outer configuration of the paper supply cassette 41 is that indicated by dashed lined in FIG. 8, when the additional paper supply cassette 202 is drawn but located within a distance (a), the additional paper supply cassette 41 is partially covered by the paper supply cassette 41 and it is difficult to set recording papers in the additional paper supply cassette 202. Thus, in that case, the additional paper supply cassette 202 must be drawn further by a distance corresponding to the distance (a).

Figure 7:
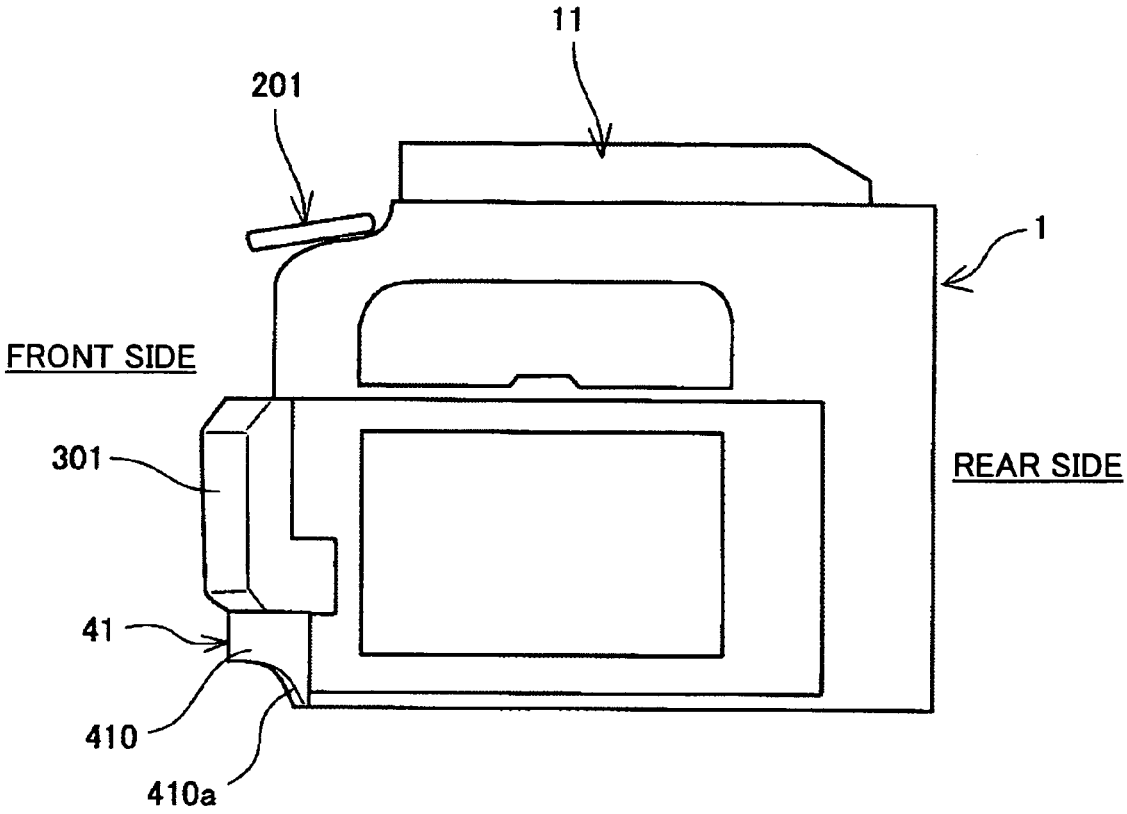
FIG. 7 is a side view of the apparatus body shown in FIG. 4 viewed from a right side.

Thus, as shown in FIG. 7, when the front side part 410 of the paper supply cassette 41 is viewed from a side, a lower portion of the relatively protruding right front cover 301 is recessed by a distance (b) and a slanting portion 410*a*, which is further recessed toward the bottom of the paper supply cassette 41, is formed. Accordingly, a space occupied by the right front cover 301 near the additional paper supply cassette 202 can be equal to that of the left front cover 302, which achieves saving of space occupied by the apparatus body 1. Additionally, the distance of the additional paper supply cassette 202 to be drawn when setting recording papers can be reduced.

Figure 9:
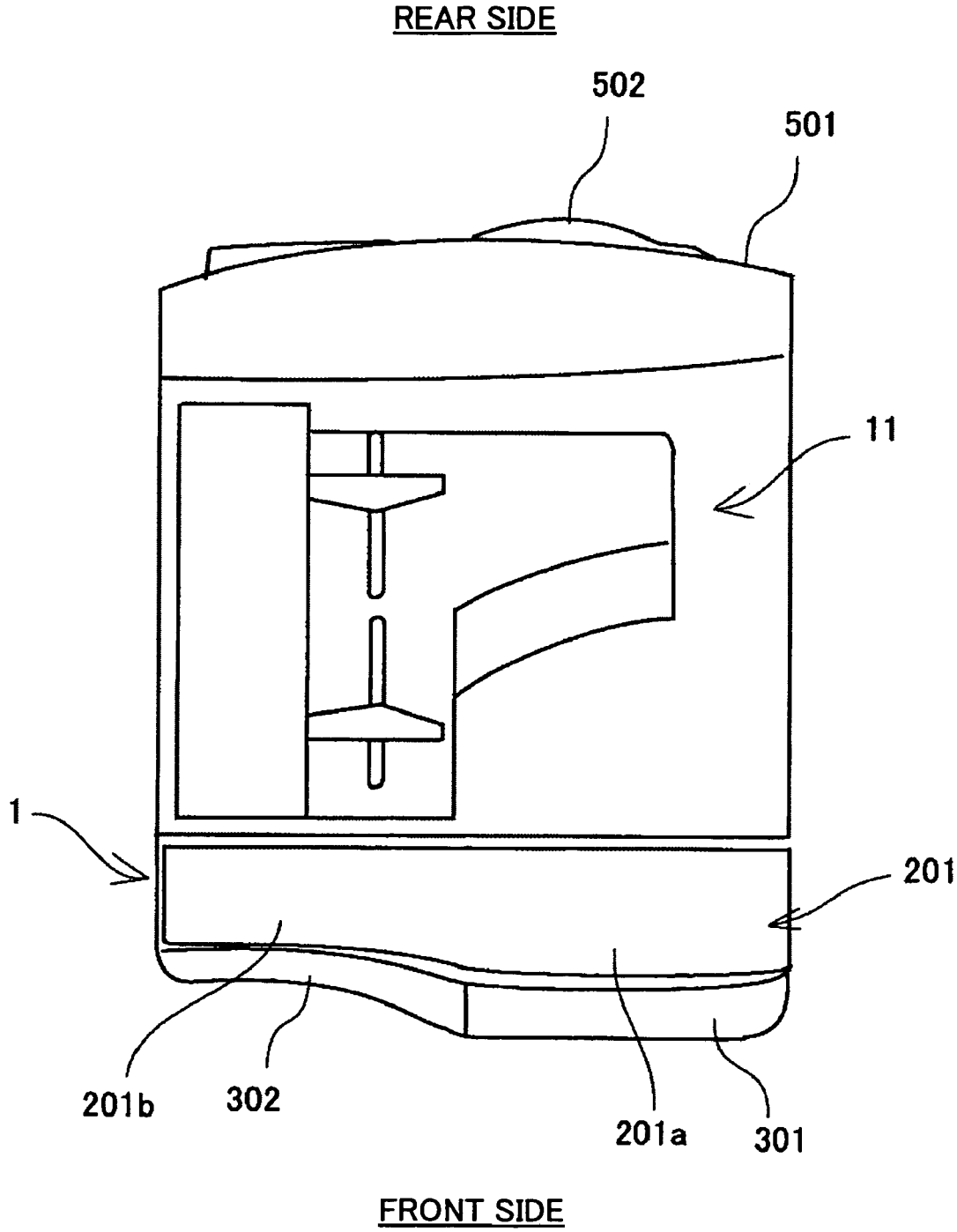
FIG. 9 is a plan view of the image forming apparatus.

A description will now be given, with reference to FIG. 9 through FIG. 11, of the configuration of the operation panel 201.

If the inner body paper eject structure is used in the image forming apparatus, the upper side of the paper eject part 8 is covered by the image reading part 11. Additionally, the operation panel 201 must be located on the front side of the apparatus, which forces an operator to see the paper eject part (paper eject tray) 8 obliquely from above, and, thereby, it is difficult to see recording papers being ejected on the paper eject tray 8.

Thus, in the present embodiment, the operation panel 201 is formed in a generally flat shape but a portion of the front side is recessed rearward. Specifically, a front portion of the left side portion 201*b* of the operation panel 201 is recessed relative to a front portion of the right side portion 201*a*. This is to match the shape of the right front cover 301 and the recessed left front cover 302, which is recessed due to the presence of the waste discharge receiving part 126 of the image forming part in the image forming apparatus according to the present embodiment.

Thus, by constituting the surface configuration of the operation panel 201, recording papers being ejected onto the paper eject tray 8 are visible easily with no obstacle, which improves convenience of use of the image forming apparatus.

Figure 10:
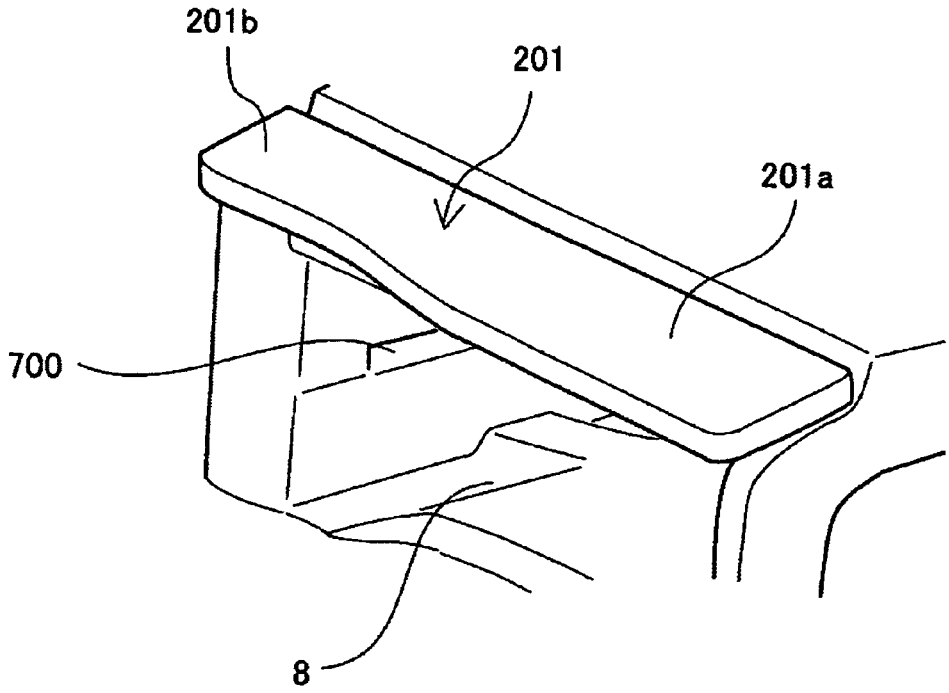
FIG. 10 is a perspective view of an operation part and a paper eject part of the image forming apparatus in a state where the operation part is at a horizontal position.
Figure 11:
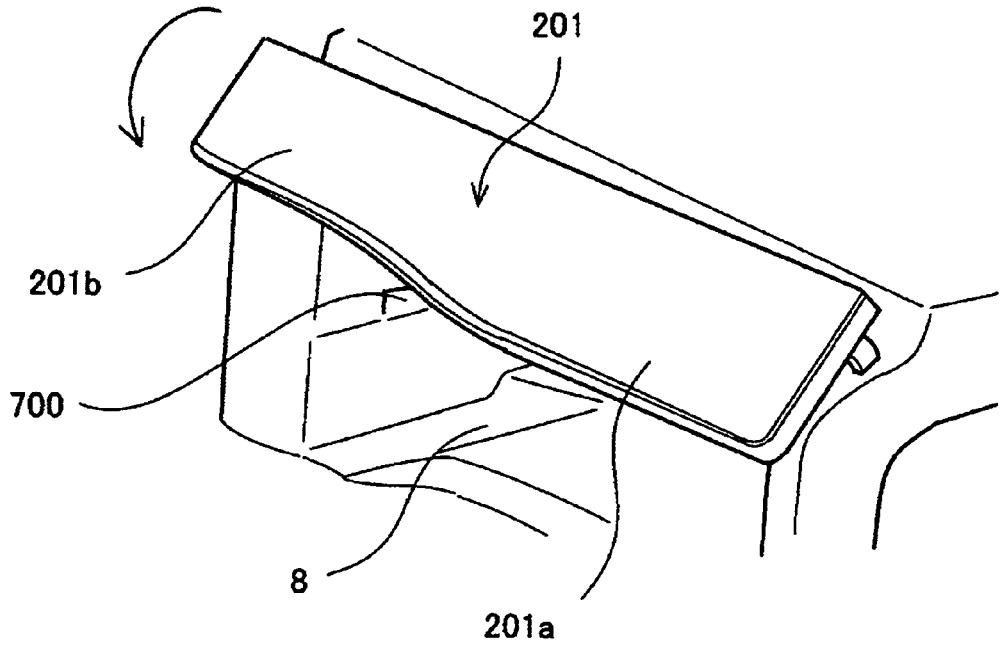
FIG. 11 is a perspective view of the operation part and the paper eject part of the image forming apparatus in a state where the operation part is tilted.

Furthermore, in the image forming apparatus according to the present embodiment, the operation panel 201 is made as a tilt-type as shown in FIG. 10 and FIG. 11. Normally, the operation panel 201 is positioned substantially horizontal in use as shown in FIG. 10 (actually, the panel is slightly inclined as shown in FIG. 7). The operation panel 201 can be tilted as indicated by an arrow in FIG. 11 so that the operation panel 201 can be operated at a lower position from the front side of the apparatus body 1. Accordingly, for example, a person sitting on a wheel chair can operate the operation panel 201 to use the image forming apparatus.

Figure 12:
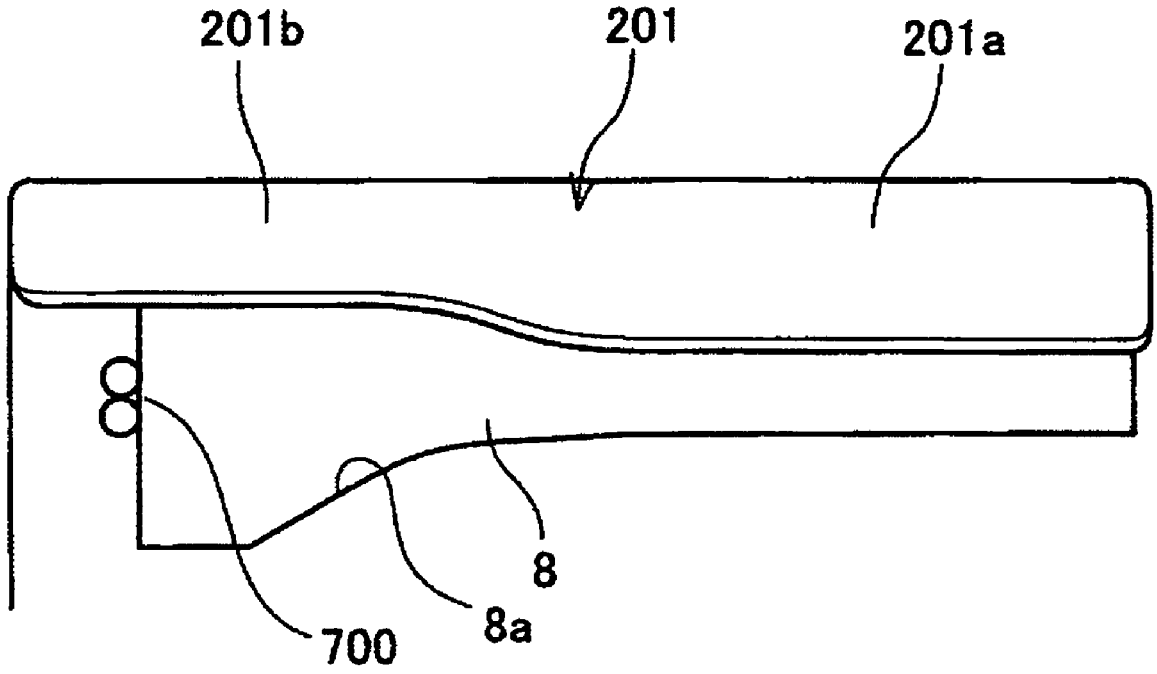
FIG. 12 is a front view of the operation part and the paper eject part in the state where the operation part is tilted.

However, when the operation panel 201 is made as a tilt-type so as to enable an increase in the inclination angle of the operation panel 201, the upper front portion of the paper eject tray 8 may be covered by the operation panel 201 as shown in FIG. 12, which makes it difficult to see recording papers being ejected onto the paper eject tray 8 or it is difficult to take out the recording papers on the paper eject tray 8.

Thus, in the present embodiment, as shown in FIG. 12 (also shown in FIG. 1), the paper receiving surface 8*a* of the paper eject tray 8 is gradually lowered toward the paper eject opening 700. Thereby, even if the operation panel 201 is largely tilted toward the front side, recording papers being ejected onto the paper eject tray 8 van be seen easily, and the recording papers can be easily taken out, which improves convenience of use of the image forming apparatus.

Next, a description will be given, with reference to FIG. 5 and FIG. 6, of the back side of the image forming apparatus according to the present embodiment.

As mentioned above, in the image forming part of a serial scan type, the maintenance and recovery of the recording head 24 is carried out. Thus, the maintenance and recovery mechanism 121 and the waste discharge receiving part 126 are provided, and the scanning area of the carriage 23 must be wider than a recording paper to be passed therethrough. Accordingly, in the structure in which the carriage 23 is moved in front-to-rear and rear-to-front directions, the maintenance and recovery mechanism 121 is located on the rear side (backside) of the apparatus body 1.

In this case, if the outer covering of the apparatus body 1 on the backside matches the shape of the maintenance and recovery mechanism 121, only a portion of the backside corresponding to the image forming part 2 protrudes and the protrusion may catch one's eye too much. Since the maintenance and recovery mechanism 121 is larger than the waste discharge receiving part 126, the protrusion on the backside becomes large.

Accordingly, in the image forming apparatus according to the present embodiment, the backside surface 501 of the apparatus body 1 is made as a curved shape so as to reduce an amount of protrusion of the portion 502 corresponding to the maintenance and recovery mechanism 121, and, thereby, the protrusion caused by the maintenance and recovery mechanism 121 of the image forming part 2 is not too much emphasized and is maintained as a low profile.

The present invention is not limited to the specifically disclosed embodiments, and variations and modifications may be made without departing from the scope of the present invention.

The present application is based on Japanese priority application No. 2005-048489 filed Feb. 24, 2005, the entire contents of which are hereby incorporated herein by reference.

What is claimed is:

1. An image forming apparatus comprising:

an apparatus body having an image forming part that forms an image by scanning a recording head discharging droplets of a recording liquid;

a paper eject part located in an upper portion of said apparatus body for stacking recording papers having the image formed thereon by said image forming part, the paper eject part being located above said recording head;

an image reading part located above said paper eject part;

an engine unit including the recording head and a maintenance and recovery mechanism configured to maintain and recover a performance of said recording head, the engine unit including the image forming part and a sub-scanning part which are incorporated into a single unit;

a waste discharge receiving part configured to receive the droplets that do not contribute formation of the image;

an eject paper conveyance part provided on a downstream side of the engine unit in a paper conveyance direction perpendicular to a scanning direction of the recording head;

an ink cartridge attaching part provided under the eject paper conveyance part and configured for an ink cartridge to be detachably attached thereto;

a right front cover provided at a position corresponding to the engine unit and configured to be opened and closed, to allow the engine unit, including the image forming part and the sub-scanning part which are incorporated into the single unit, to be assembled to the apparatus body; and a left front cover provided at a position corresponding to the ink cartridge attaching part and configured to be opened and closed in order to replace the ink cartridge, wherein when viewed from above, the right front cover corresponding to the waste discharge receiving part of the engine unit projects relative to the left front cover, and the left front cover corresponding to the ink cartridge attaching part is retracted relative to the right front cover, and wherein said apparatus body accommodates said maintenance and recovery mechanism and said waste discharge receiving part therein on both ends of a scanning range of said recording head.

2. The image forming apparatus as claimed in claim 1 wherein said maintenance and recovery mechanism and said waste discharge receiving part are located on opposite end sides of said apparatus body in a front-to-rear direction thereof.

3. The image forming apparatus as claimed in claim 2, wherein a paper supply cassette for accommodating the recording papers therein is detachably attached under said image forming part in said apparatus body, and an outer configuration of said paper supply cassette has a slanting part when viewed from a side, the slanting part slanting rearward from a relatively protruded part of a front face of said paper supply cassette, the relatively protruded part corresponding to at least one of said maintenance and recovery mechanism and said waste discharge receiving part.

4. The image forming apparatus as claimed in claim 3, wherein a backside of said apparatus body is formed in a curved shape.

5. The image forming apparatus as claimed in claim 1 wherein a paper supply cassette for accommodating the recording papers therein is detachably attached under said image forming part in said apparatus body, and an outer configuration of said paper supply cassette has a slanting part when viewed from a side, the slanting part slanting rearward from a relatively protruded part of a front face of said paper supply cassette, the relatively protruded part corresponding to at least one of said maintenance and recovery mechanism and said waste discharge receiving part.

6. The image forming apparatus as claimed in claim 5, wherein a backside of said apparatus body is formed in a curved shape.

7. The image forming apparatus as claimed in claim 1, further comprising an operation part located above said paper eject part and on a front side of said apparatus body, wherein said operation part has a substantially flat shape in which a part of a front edge thereof is recessed rearward.

8. The image forming apparatus as claimed in claim 7, wherein said operation part is configured and arranged to be tilted to face forward, and said paper eject part has a shape lowered toward a paper eject opening from which the recording papers are ejected.

9. The image forming apparatus as claimed in claim 1, further comprising an operation part located above said paper eject part and on a front side of said apparatus body, wherein said operation part is configured and arranged to be tilted to face forward, and said paper eject part has a shape lowered toward a paper eject opening from which the recording papers are ejected.

* * * * *